US008125421B2

(12) United States Patent
Choi et al.

(10) Patent No.: US 8,125,421 B2
(45) Date of Patent: Feb. 28, 2012

(54) DATA DRIVER AND ORGANIC LIGHT EMITTING DISPLAY DEVICE INCLUDING THE SAME

(75) Inventors: Sang Moo Choi, Swon (KR); Hong Kwon Kim, Euiwang (KR); Oh Kyong Kwon, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1022 days.

(21) Appl. No.: 11/317,792

(22) Filed: Dec. 22, 2005

(65) Prior Publication Data

US 2006/0139263 A1 Jun. 29, 2006

(30) Foreign Application Priority Data

Dec. 24, 2004 (KR) ..... 10-2004-0112533

(51) Int. Cl.
*G09G 3/32* (2006.01)

(52) U.S. Cl. ..... 345/82

(58) Field of Classification Search ..... 343/82, 343/83; 315/169.3

See application file for complete search history.

(56) References Cited

U.S. PATENT DOCUMENTS

| | | | | |
|---|---|---|---|---|
| 5,287,070 | A * | 2/1994 | Thelen et al. | 330/253 |
| 5,446,409 | A * | 8/1995 | Katakura | 327/538 |
| 6,433,488 | B1 * | 8/2002 | Bu | 315/169.3 |
| 6,452,448 | B1 * | 9/2002 | Bonaccio et al. | 330/253 |
| 6,777,885 | B2 * | 8/2004 | Koyama | 315/169.1 |
| 7,042,426 | B2 | 5/2006 | Shin | |
| 7,071,906 | B2 | 7/2006 | Nishitani et al. | |
| 7,109,952 | B2 | 9/2006 | Kwon | |
| 7,109,953 | B2 | 9/2006 | Abe et al. | |
| 7,129,643 | B2 | 10/2006 | Shin et al. | |
| 7,180,493 | B2 | 2/2007 | Shin et al. | |
| 7,248,237 | B2 | 7/2007 | Yamada et al. | |
| 7,362,249 | B2 | 4/2008 | Kim et al. | |
| 7,515,121 | B2 | 4/2009 | Sato et al. | |

(Continued)

FOREIGN PATENT DOCUMENTS

JP 2003-186457 7/2003

(Continued)

OTHER PUBLICATIONS

Patent Abstracts of Japan, Publication No. 2005-024698; Publication Date: Jan. 27, 2005; in the name of Uchino, et al.

(Continued)

*Primary Examiner* — Chanh Nguyen
*Assistant Examiner* — Jonathan Blancha
(74) *Attorney, Agent, or Firm* — Christie, Parker & Hale, LLP

(57) ABSTRACT

A data driver and an organic light emitting display device including the data driver. The data driver including a shift register part to generate sampling signals in sequence, a latch part to store external data in response to the sampling signals, a current digital-analog converter to generate a data current corresponding to the data stored in the latch part, and a comparator producing a current corresponding to the difference between a pixel current and the data current. The comparator compares the pixel current fed back from each pixel with the data current, controls the data voltage by increasing or decreasing the current output, and supplies the controlled data voltage to the pixel. By controlling the data voltage an image is displayed with desired brightness regardless of non-uniformity of transistors in each pixel.

17 Claims, 6 Drawing Sheets

U.S. PATENT DOCUMENTS

| | | | | |
|---|---|---|---|---|
| 2002/0000828 | A1* | 1/2002 | Krause et al. | 324/765 |
| 2002/0089357 | A1* | 7/2002 | Pae et al. | 327/112 |
| 2003/0020413 | A1 | 1/2003 | Oomura | |
| 2003/0142048 | A1 | 7/2003 | Nishitani et al. | |
| 2003/0227262 | A1 | 12/2003 | Kwon | |
| 2004/0012580 | A1 | 1/2004 | Yamagishi et al. | |
| 2004/0174283 | A1 | 9/2004 | Sun | |
| 2004/0179003 | A1* | 9/2004 | Jang | 345/204 |
| 2004/0196223 | A1 | 10/2004 | Kwon | |
| 2004/0201556 | A1* | 10/2004 | Oomori et al. | 345/76 |
| 2004/0256617 | A1 | 12/2004 | Yamada et al. | |
| 2004/0263444 | A1* | 12/2004 | Kimura | 345/82 |
| 2005/0052350 | A1* | 3/2005 | Mizukoshi et al. | 345/55 |
| 2005/0052366 | A1 | 3/2005 | Kim | |
| 2005/0121672 | A1 | 6/2005 | Yamazaki et al. | |
| 2005/0200300 | A1 | 9/2005 | Yumoto | |
| 2006/0038758 | A1 | 2/2006 | Routley et al. | |
| 2006/0139264 | A1 | 6/2006 | Choi et al. | |
| 2006/0139276 | A1 | 6/2006 | Choi et al. | |
| 2007/0080908 | A1* | 4/2007 | Nathan et al. | 345/77 |
| 2008/0013349 | A1* | 1/2008 | Yanagida et al. | 363/60 |
| 2008/0024099 | A1* | 1/2008 | Oki et al. | 323/282 |

FOREIGN PATENT DOCUMENTS

| | | |
|---|---|---|
| JP | 2004-361888 | 12/2004 |
| JP | 2005-24698 | 1/2005 |

OTHER PUBLICATIONS

U.S. Office action dated Sep. 3, 2009, for related U.S. Appl. 11/312,227, noting listed U.S. references in this IDS.

Patent Abstracts of Japan, Publication No. 2003-186457, dated Jul. 4, 2003, in the name of Seung-Woo Lee.

Patent Abstracts of Japan, Publication No. 2004-361888, dated Dec. 24, 2004, in the name of Tomoyuki Shirasaki.

U.S. Office action dated Jan. 20, 2010, for related U.S. Appl. 11/312,227.

U.S. Office action dated Apr. 2, 2010, for related U.S. Appl. 11/312,227.

U.S. Notice of Allowance dated Aug. 26, 2010, for cross reference U.S. Appl. 11/312,227, noting listed reference in this IDS.

* cited by examiner

DATA DRIVER AND ORGANIC LIGHT EMITTING DISPLAY DEVICE INCLUDING THE SAME

CROSS-REFERENCE TO RELATED APPLICATION

This application claims priority to and the benefit of Korean Patent Application No. 10-2004-0112533, filed on Dec. 24, 2004, in the Korean Intellectual Property Office, the entire content of which is incorporated herein by reference.

BACKGROUND OF THE INVENTION

1. Field of the Invention

The present invention relates to a data driver and an organic light emitting display device including the same, and more particularly, to a data driver and an organic light emitting display device including the same, in which an image is displayed with desired brightness.

2. Discussion of Related Art

Various flat panel displays have recently been developed as alternatives to a relatively heavy and bulky cathode ray tube (CRT) display device. The flat panel display devices include liquid crystal displays (LCDs), field emission displays (FEDs), plasma display panels (PDPs), organic light emitting diode (OLED) displays, etc.

Among the flat panel display devices, the organic light emitting diode display device can emit light by electron-hole recombination. Such an organic light emitting diode display device has advantages of relatively fast response time and relatively low power consumption. Typically, the organic light emitting diode display device employs a transistor provided in each pixel for supplying current corresponding to a data signal to an organic light emitting diode, thereby enabling the organic light emitting diode to emit light.

FIG. 1 illustrates a conventional organic light emitting diode display device.

Referring to FIG. 1, a conventional organic light emitting diode display device includes a display region 30 including pixels 40 formed in a region defined by intersection of scan lines S1 through Sn and data lines D1 through Dm; a scan driver 10 to drive the scan lines S1 through Sn; a data driving part 20 to drive the data lines D1 through Dm; and a timing controller 50 to control the scan driver 10 and the data driving part 20. Each pixel 40 includes a transistor for supplying current to a light emitting device (not shown).

The timing controller 50 generates a data control signal DCS and a scan control signal SCS corresponding to an external synchronization signal. The data control signal DCS and the scan control signal SCS are supplied from the timing controller 50 to the data driving part 20 and the scan driver 10, respectively. Further, the timing controller 50 supplies external data to the data driving part 20.

The scan driver 10 receives the scan control signal SCS from the timing controller 50. The scan driver 10 generates scan signals on the basis of the scan control signal SCS and supplies the scan signals to the scan lines S1 through Sn.

The data driving part 20 receives the data control signal DCS from the timing controller 50. The data driving part 20 generates data signals on the basis of the data control signal DCS and supplies the data signals to the data lines D1 through Dm in synchronization with the scan signals.

The display portion 30 receives a first voltage ELVDD and a second voltage ELVSS from an external power source, and supplies them to the pixels 40. When the first voltage ELVDD and the second voltage ELVSS are applied to the pixels 40, each pixel 40 controls a current corresponding to the data signal to flow from a first power source line supplying the first voltage ELVDD to a second power source line supplying the second voltage ELVSS via an organic light emitting diode, thereby emitting light corresponding to the data signal.

Therefore, in the conventional organic light emitting diode display device, each pixel 40 emits light with a predetermined brightness corresponding to the data signal. However, the pixels 40 do not generally emit light with a desired brightness because the transistors provided in the respective pixels 40 have different threshold voltages. Further, in the conventional organic light emitting diode display device, there is no method of measuring and controlling a real current in each pixel 40 corresponding to the data signal.

SUMMARY OF THE INVENTION

Accordingly, it is an aspect of the present invention to provide a data driver and an organic light emitting diode display device including the same, in which an image is displayed with desired brightness.

One embodiment of the present invention provides a data driver including a shift register part to generate sampling signals, a latch part to store external data in response to the sampling signals, a current digital-analog converter to generate a data current corresponding to the data stored in the latch part, and a comparator including a first input terminal for receiving the data current, a second input terminal for receiving a pixel current in a pixel, and an output terminal for outputting a current corresponding to a difference between the pixel current and the data current, where the comparator compares the pixel current with the data current, controls the data voltage by increasing or decreasing the current outputted through the output terminal of the comparator, and supplies the controlled data voltage to the pixel.

Another embodiment of the present invention provides an organic light emitting diode display device including a display region having scan lines, data lines, feedback lines or lines having a feedback function, and pixels coupled to the scan lines, the data lines and the feedback lines or lines having a feedback function, a scan driver to supply scan signals to the scan lines in sequence, and a data driver coupled to the data lines and the feedback lines, and supplying a data voltage as a data signal to the data lines, where the data driver includes the data driver of the first embodiment.

Another embodiment presents a method for controlling image brightness in an organic light emitting display device having a pixel for emitting light and forming an image. The method includes generating a sampling signal, storing data in a register in response to the sampling signal, generating a data current corresponding to the stored data, comparing the data current with a pixel current generated in the pixel, generating an output current corresponding to a difference between the pixel current and the data current, controlling the data voltage by increasing or decreasing the output current, and supplying the controlled data voltage to the pixel to obtain a desired image brightness.

DETAILED DESCRIPTION

Figure 1:
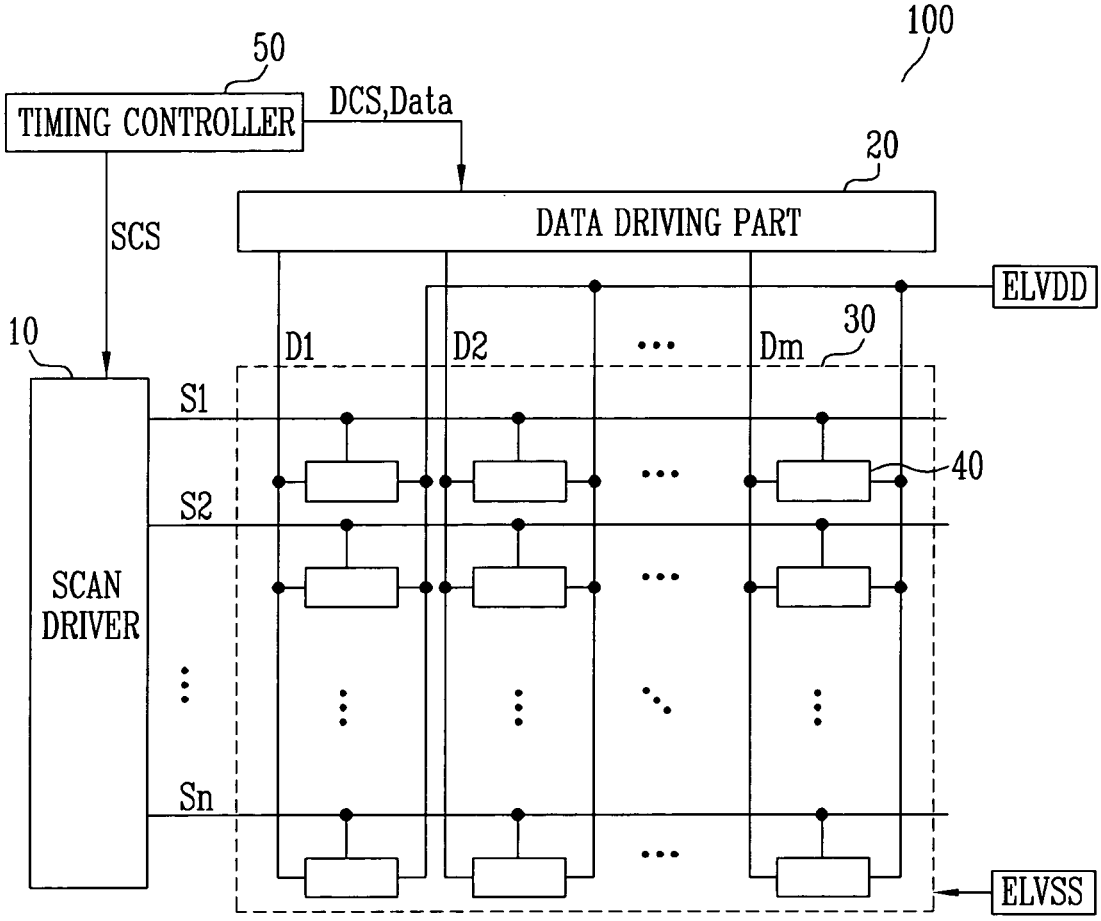
FIG. 1 (PRIOR ART)
FIG. 1 is a layout diagram showing a conventional organic light emitting diode display device.
Figure 2:
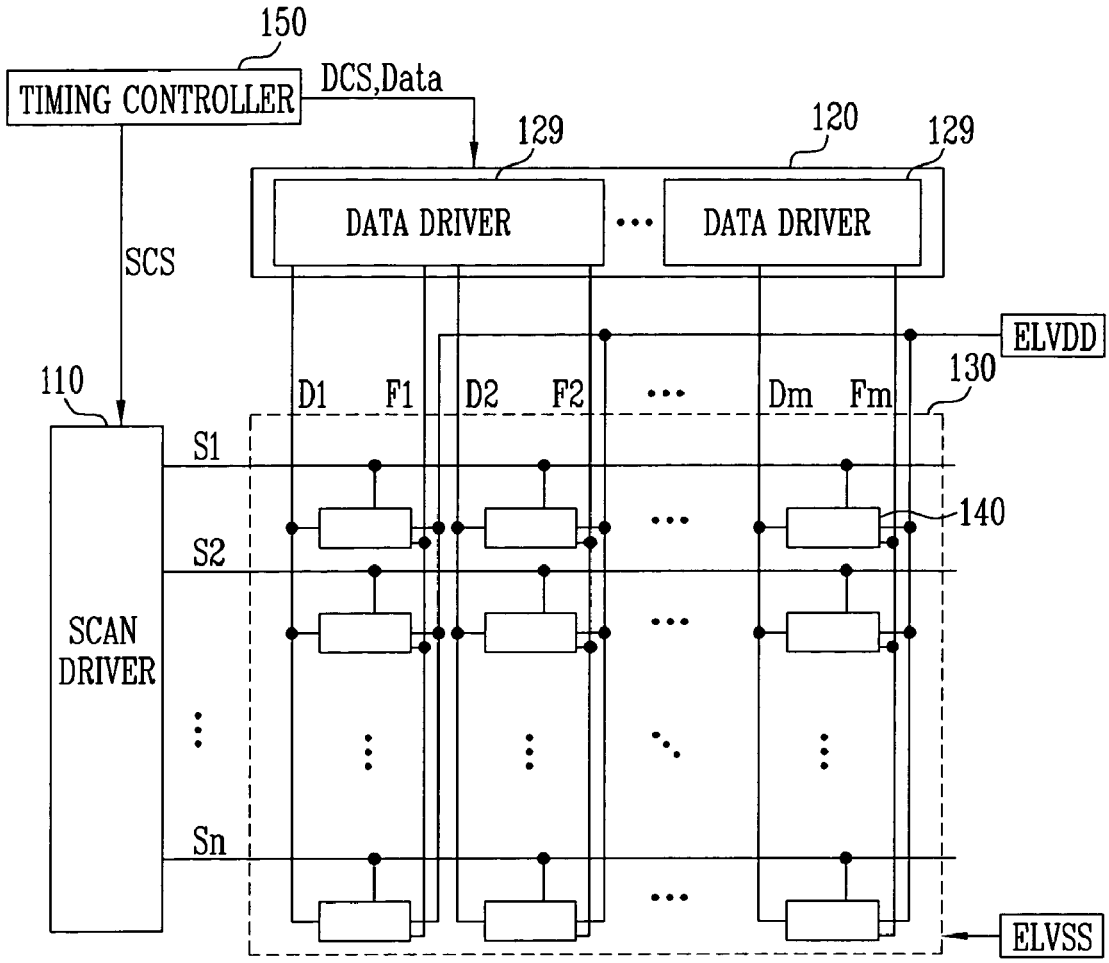
FIG. 2 is a layout diagram showing an organic light emitting diode display device according to an embodiment of the present invention.

FIG. 2 illustrates an organic light emitting diode display device according to an embodiment of the present invention.

Referring to FIG. 2, the organic light emitting diode display device of the present invention includes a display region 130 including pixels 140 formed on a region formed at intersections of scan lines S1 through Sn, data lines D1 through Dm, and feedback lines F1 through Fm. The organic light emitting diode display device also includes a scan driver 110 to drive scan lines S1 through Sn, a data driving part 120 to drive data lines D1 through Dm, and a timing controller 150 to control the data driving part 120.

The display region 130 includes the pixels 140 coupled with the scan lines S1 through Sn, the data lines D1 through Dm, and the feedback lines F1 through Fm. The scan lines S1 through Sn are formed in a row direction and supply a scan signal to the pixels 140. The data lines D1 through Dm are formed in a column direction and supply a data signal to the pixels 140. The feedback lines F1 through Fm receive a pixel current corresponding to the data signal from pixels 140 and supply it back to the data driving part 120.

The feedback lines F1 through Fm are formed in the same direction (column direction) as the data lines D1 through Dm. The feedback lines F1 through Fm receive a current from the pixels 140 to which the data signal is currently supplied. The pixel current is generated at the pixels 140 currently receiving the scan signal, and is returned to the data driving part 120 by the feedback lines F1 through Fm.

A first voltage ELVDD and a second external voltage ELVSS are applied to the pixels 140. These voltages may be applied by external voltage sources. When the first voltage ELVDD and the second voltage ELVSS are applied to the pixels 140, each pixel 140 controls the pixel current corresponding to the data signal, in the corresponding one of the data lines D1 through Dm, from a first power source line supplying the first voltage ELVDD to a second power source line supplying the second voltage ELVSS via the organic light emitting diode OLED. Further, the pixels 140 supply the pixel current during a predetermined period of one horizontal period.

The timing controller 150 generates a data driving control signal DCS and a scan driving control signal SCS corresponding to the external synchronization signals. The data driving control signal DCS and the scan driving control signal SCS are supplied to the data driving part 120 and the scan driver 110 respectively. Further, the timing controller 150 supplies the external data to the data driving part 120.

The scan driver 110 receives the scan driving control signal SCS from the timing controller 150 and generates the scan signals, thereby supplying the scan signals to the scan lines S1 through Sn in sequence.

The data driving part 120 receives the data driving control signal DCS from the timing controller 150 and generates the data signals that are supplied to the data lines D1 through Dm in synchronization with the scanning signal. The data driving part 120 applies a predetermined data voltage as a data signal to the corresponding one of the data lines D1 through Dm.

The data driving part 120 also receives the pixel current from the pixels 140 through feedback lines F1 through Fm. The data driving part 120 receives the pixel current and checks to determine whether the intensity of pixel current corresponds to the data. For example, in the case when the pixel current in the pixel 140 should have an intensity of 10 μA corresponding to a bit value (or digital value) of the data, the data driving part 120 checks to determine whether the pixel current supplied from the pixel 140 is 10 μA or not.

When the desired current is not being supplied to each pixel 140, the data driving part 120 controls the value of the data in order to cause the desired current to flow to each pixel 140. For this, the data driving part 120 includes at least one data driver 129 having j channels (where, j is a natural number). For the sake of convenience, FIG. 2 exemplarily illustrates two data drivers 129.

Figure 3:
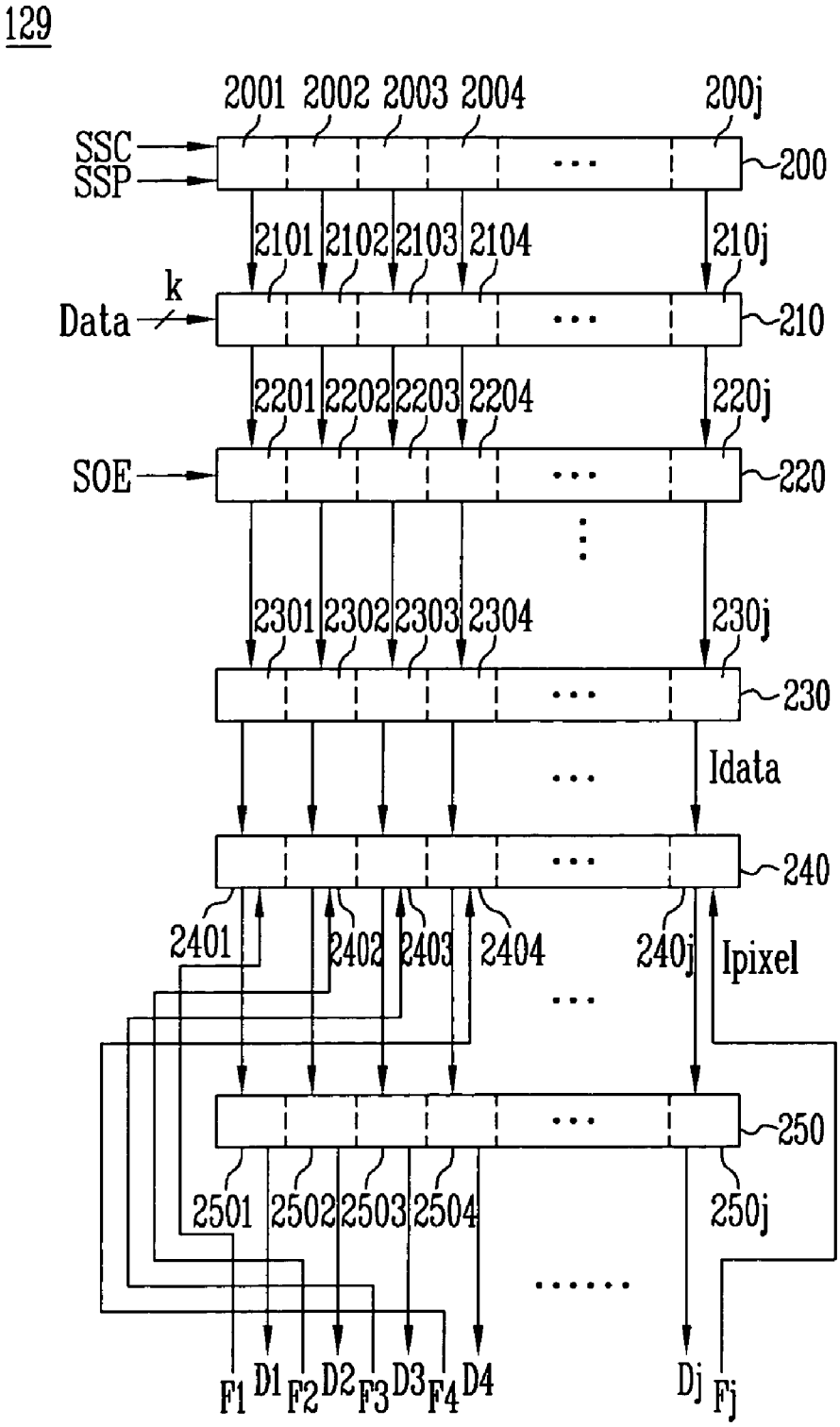
FIG. 3 is a schematic block diagram illustrating a first embodiment of a data driver illustrated in FIG. 2.

FIG. 3 is a block diagram illustrating a first embodiment of the data driver 129 illustrated in FIG. 2. Referring to FIG. 3, the first embodiment 129 of the data driver 129 includes a shift register part 200 to generate sampling signals in sequence, a sampling latch part 210 to sequentially store data Data in response to the sampling signals, a holding latch part 220 to temporarily store the data Data stored in the sampling latch part 210 and supply the data Data to a current digital-analog converter (DAC) 230, the DAC 230 to generate a data current Idata corresponding to the gradation value of the data Data, a voltage control block 240 to control the data voltage Vdata on the basis of the pixel current Ipixel supplied through the feedback lines F1 through Fj, and a buffer part 250 to supply the data voltage Vdata from the voltage control block 240 to the data lines D1 through Dj.

The shift register part 200 receives a source shift clock SSC and a source start pulse SSP from the timing controller 150, and outputs j sampling signals sequentially while shifting the source start pulse SSP per one cycle of the source shift clock SSC. The shift register part 200 includes j shift registers (2001 through **200*j***).

The sampling latch part 210 stores the data Data in response to the sampling signals sequentially transmitted from the shift register part 200. The sampling latch part 210 includes j sampling latches 2101 through **210*j* in order to store j data Data. Further, each sampling latch 2101 through 210*j* has a size corresponding to the bit value of the data Data. For example, in the case of the data Data of k bits, each sampling latch 2101 through 210*j*** is set to have a size of k bits.

The holding latch part 220 receives the data Data from the sampling latch part 210 and stores it in response to a source output enable signal SOE. Further, the holding latch part 220 supplies the data Data it has stored to the DAC 230 in response to the source output enable signal SOE. Here, the holding latch part 220 includes j holding latches 2201 through **220*j*** each having a size of k bits.

The DAC 230 generates the data current Idata corresponding to the bit value of the data Data, and supplies the data current Idata to the voltage control block 240. Here, the DAC 230 generates j data currents Idata corresponding to j data Data supplied from the holding latch part 220.

The voltage control block 240 receives the data current Idata and the pixel current Ipixel, and compares the data current Idata with the pixel current Ipixel, thereby controlling the data voltage Vdata on the basis of a current difference between the data current Idata and the pixel current Ipixel. Ideally, the voltage control block 240 controls the level of the data voltage Vdata so as to equalize the data current Idata to the pixel current Ipixel. The voltage control block 240 includes j voltage controllers 2401 through 240*j*.

The buffer part 250 supplies the data current Idata from the voltage control block 240 to j data lines D1 through Dj. Here, the buffer part 250 includes j buffers 2501 through 250*j*. Further, a unit gain buffer can be employed as the buffer.

Figure 4:
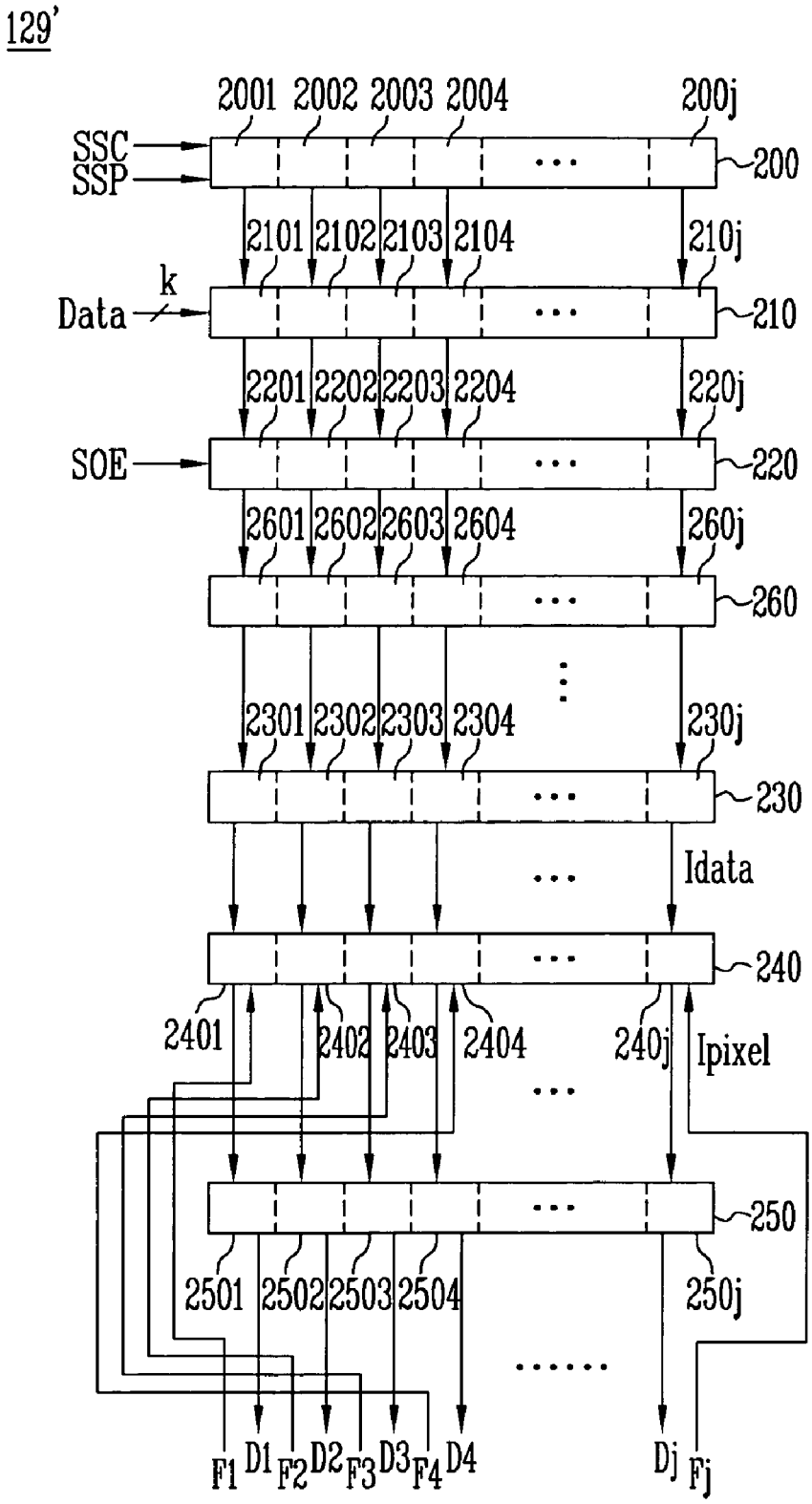
FIG. 4 is a schematic block diagram illustrating a second embodiment of the data driver illustrated in FIG. 2.

A data driver 129' according to a second embodiment of the present invention is shown in FIG. 4. The second embodiment data driver 129' further includes a level shifter part 260 between the holding latch part 220 and the DAC 230 as shown in FIG. 4. The level shifter part 260 increments a voltage level of the data Data supplied from the holding latch part 220, and supplies it to the DAC 230. When the data Data having a high voltage level is supplied from an external system to the data driver 129, circuit elements capable of handling the high voltage level are required and the production cost is increased. However, when using the data driver 129' of the second embodiment, the level shifter part 260 can increment the voltage level of the data Data to a high level. As a result, the external system may supply the data Data having a low voltage level to the data driver 129', and additional circuit elements capable of handling a high voltage level are not required, thereby reducing production cost. The level shifter part 260 includes j level shifters 2601 through 260*j*.

Figure 5:
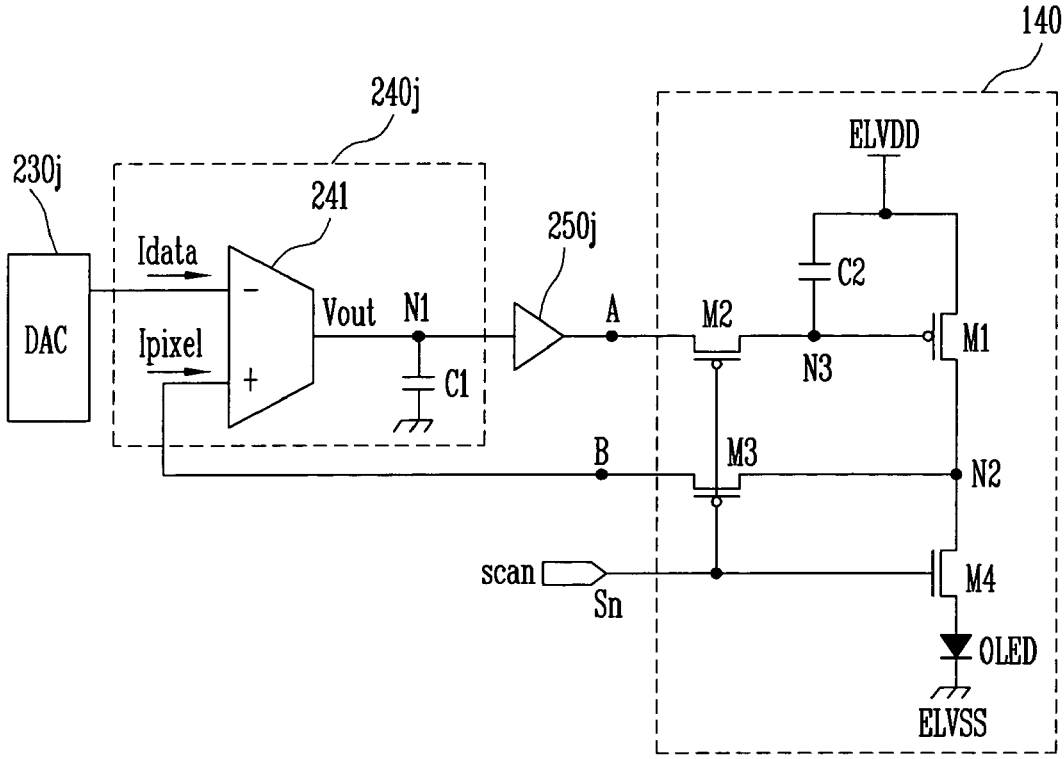
FIG. 5 is a circuit diagram illustrating a first embodiment of a voltage control block employed in the organic light emitting diode display device according to an embodiment of the present invention.

FIG. 5 is a circuit diagram illustrating a first embodiment of a voltage control block employed in the organic light emitting diode display device according to an embodiment of the present invention. For the sake of convenience, FIG. 5 illustrates the $j^{th}$ voltage controller 240*j* and the pixel 140 coupled to the $j^{th}$ voltage controller 240*j*. Referring to FIG. 5, the voltage controller 240*j* includes a comparator 241 and a first capacitor C1. The pixel includes the pixel circuit and an organic light emitting diode OLED. The pixel circuit 140 includes first, second, third, and fourth transistors M1, M2, M3, M4 and a second capacitor C2. The buffer 250*j* is coupled between the voltage controller 240*j* and the pixel 140.

In the voltage controller 240*j*, the comparator 241 has a first input terminal to receive the data current Idata, and a second input terminal to receive the pixel current Ipixel as feedback. The pixel current Ipixel is fed back from the pixel 140 to which the data signal is currently supplied to the comparator 241. The comparator 241 compares the data current Idata with the pixel current Ipixel, and supplies a current based on the comparison results to the pixel 140.

The first capacitor C1 is coupled to a first node N1, and is charged by the current received from the comparator 241 to the data voltage corresponding to the charging current. The data voltage is supplied to the pixel 140. The level of the data voltage is controlled corresponding to the comparison results of the comparator 241 on the basis of the difference between the data current Idata and the pixel current Ipixel. That is, the data voltage applied to the first capacitor C1 is varied depending on both the data current Idata and the pixel current Ipixel.

The data voltage is supplied to the buffer 250*j*, and the buffer 250*j* stably supplies the data voltage to the pixel 140. The first capacitor C1 may be a parasitic capacitor coupled to the data line.

The pixel 140 includes first, second, third, and fourth transistors M1, M2, M3, M4, each transistor having a source, a drain, and a gate. There is no physical difference between the source and the drain, and the source and the drain can be called a first electrode and a second electrode, respectively. In the example shown, the first, second, and third transistors M1, M2, M3 are PMOS transistors, and the fourth transistor M4 is an NMOS transistor.

The source of the first transistor M1 is coupled to a pixel power source line supplying the first voltage ELVDD, its drain is coupled to a second node N2, and its gate is coupled to a third node N3. The first transistor M1 generates the pixel current Ipixel and controls the level of the pixel current Ipixel depending on a voltage applied to the third node N3.

The source of the second transistor M2 is coupled to the data line, its drain is coupled to the third node N3, and its gate is coupled to the scan line Sn. The second transistor M2 supplies the data voltage from the data line to the third node N3 when a low scan signal LOW is supplied through the scan line Sn to the gate of the second transistor M2.

The source of the third transistor M3 is coupled to the second node N2, its drain is coupled to the second terminal of the comparator 241, and its gate is coupled to the scan line Sn. The third transistor M3 controls the pixel current Ipixel to flow from the second node N2 to the second input terminal of the comparator 241 when the low scan signal LOW is supplied through the scan line Sn, thereby enabling the comparator 241 to compare the pixel current Ipixel generated by the first transistor M1 with the data current Idata supplied from the DAC 230.

The source of the fourth transistor M4 is coupled to the second node N2, its drain is coupled to the organic light emitting diode OLED, and its gate is coupled to the scan line Sn. The fourth transistor M4 controls the pixel current Ipixel to flow from the second node N2 to the organic light emitting diode OLED when a high scan signal HIGH is supplied through the scan line Sn to the gate of the fourth transistor M4, thereby enabling the organic light emitting diode OLED to emit light based on the pixel current Ipixel.

Figure 6:
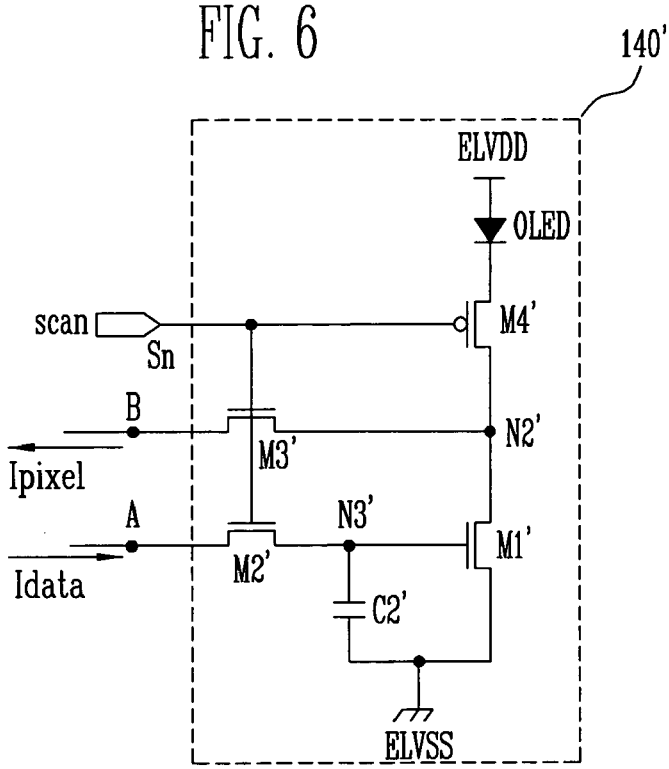
FIG. 6 is a circuit diagram of a pixel illustrated in FIG. 5.

In an alternative embodiment shown in FIG. 6, first, second, and third transistors M1', M2', M3' of a pixel 140' may be NMOS transistors while the fourth transistor M4' is a PMOS transistor. In this alternative embodiment, the first input terminal of the comparator 241 receives the pixel current Ipixel, and the second input terminal of the comparator 241 receives the data current Idata from the DAC 230.

Figure 7:
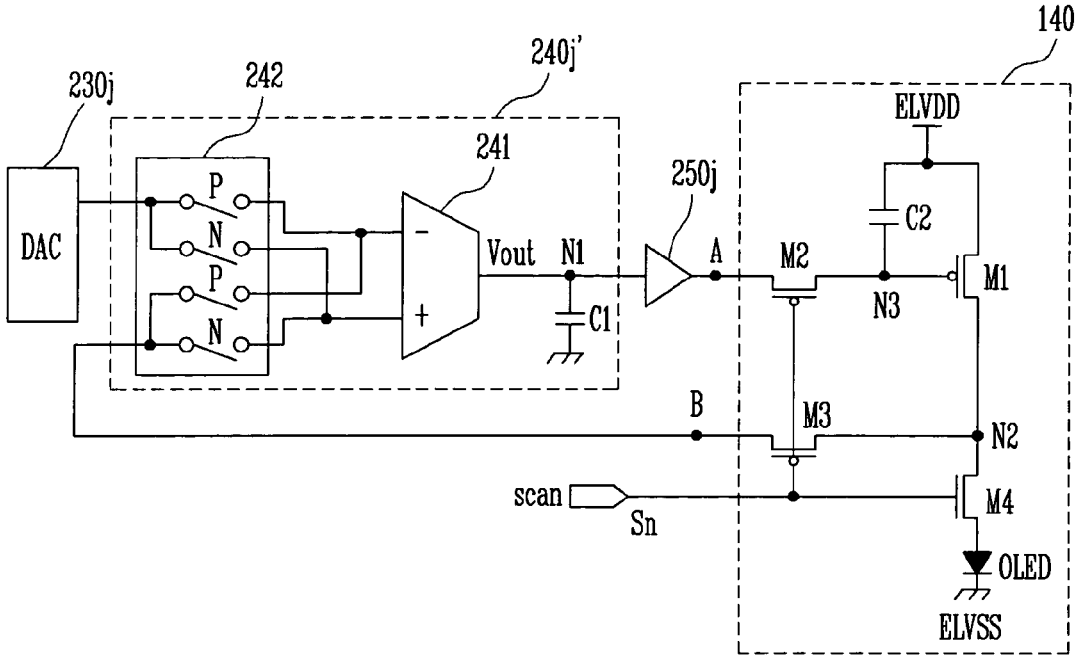
FIG. 7 is a circuit diagram illustrating a second embodiment of a voltage control block employed in the organic light emitting diode display device according to an embodiment of the present invention.

As shown in FIG. 7, a switching part 242 may be provided between the DAC 230 and the comparator 241, so that the data current Idata of the DAC 230 and the pixel current Ipixel fed back from the pixel 140 can be switched, thereby supplying the data current Idata to the first input terminal of the comparator 241 and the pixel current Ipixel to the second input terminal of the comparator 241, or supplying the data current Idata to the second input terminal of the comparator 241 and the pixel current Ipixel to the first input terminal of the comparator 241. Thus, the DAC 230 and the comparator 241 are coupled to each other regardless of the kind of transistors forming the pixel 140. Consequently, the data driver 129, 129' can be fabricated independently from the kind of the transistors forming the pixel 140, 140'.

For example, the switching part 242 includes four switches, i.e., first, second, third, and fourth switches S1, S2, S3, S4. The first switch S1 is coupled between an output terminal of the DAC 230 and the first input terminal of the comparator 241. The second switch S2 is coupled between the output terminal of the DAC 230 and the second input terminal of the comparator 241. The third switch S3 is coupled between the feedback line of the pixel 140 and the first input terminal of the comparator 241. The fourth switch S4 is coupled between the feedback line of the pixel 140 and the second input terminal of the comparator 241. With this configuration, the data current Idata and the pixel current Ipixel may be respectively input to the first and second, or the second and first, input terminals of the comparator 241 depending on the state of the switches.

Figure 8:
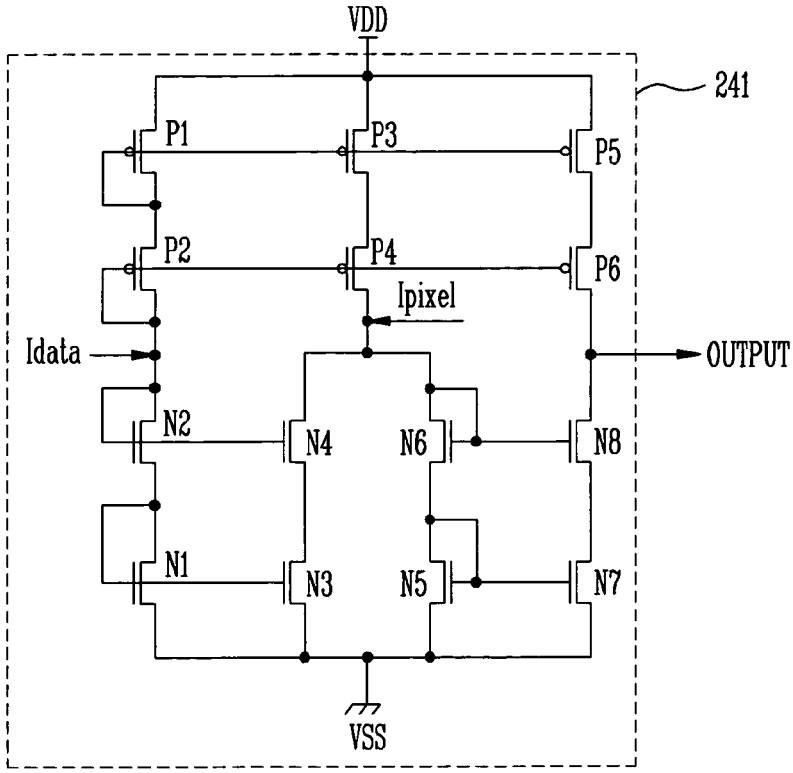
FIG. 8 is a circuit diagram of a comparator illustrated in FIGS. 5 and 6.

FIG. 8 is a circuit diagram of the comparator 241 illustrated in FIGS. 5 and 6. Referring to FIG. 8, the comparator 241 includes seven drivers and is coupled between the first and second power source lines supplying the first voltage ELVDD and the second voltage ELVSS. Further, the comparator 241 includes the first input terminal to receive the data current Idata, and the second input terminal to receive the pixel current Ipixel. Also, the comparator 241 includes one output terminal to output a current obtained by compensating the difference between the pixel current Ipixel and the data current Idata and proportional to this difference.

A first driver is coupled between the first power source line supplying the first voltage ELVDD and the first input terminal. A second driver is coupled between the first power source line supplying the first voltage ELVDD and the second input terminal. A third driver is coupled between the first power source line supplying the first voltage ELVDD and the output terminal. Each of the first through third drivers includes a gate and generates a current according to signals applied to its gate. Further, the gates of the first through third drivers are coupled to each other and operate in response to the same signal. The currents in the first and third drivers are equalized. The gate of the second driver is adjusted in size, thereby enabling the current twice higher than the current in the first driver to flow in the second driver.

A fourth driver is coupled between the second power source line supplying the second voltage ELVSS and the first input terminal. A fifth and a sixth driver are coupled between the second power source line supplying the second voltage ELVSS and the second input terminal. A seventh driver is coupled between the second power source line supplying the second voltage ELVSS and the output terminal. Each of the fourth through seventh drivers includes a gate and generates a current according to signals applied to its gate. The gates of the fourth and fifth drivers are coupled together and operate in response to the same signal, so that the currents in the fourth and fifth drivers are equalized. Likewise, the gates of the sixth and seventh drivers are coupled together and operate in response to the same signal, so that the currents in the sixth and seventh drivers are equalized.

According to an embodiment of the present invention, the first driver and the sixth driver are coupled like a diode, so that a current corresponding to the data current Idata flows in the first driver when the data current Idata is inputted through the first input terminal, and a current corresponding to the pixel current Ipixel flows in the sixth driver when the pixel current Ipixel is inputted through the second input terminal.

Each of the first, second, and third drivers includes two PMOS transistors, and each of the fourth, fifth, sixth, and seventh drivers includes two NMOS transistors.

With this configuration, the comparator 241 operates as follows. When the data current Idata is inputted through the first input terminal, the first switch is coupled like a diode by the data current Idata, so that a first current may go through the first switch. A second current twice higher than the first current flows through the second switch. A current equal to the first current flows through the third switch.

A third current obtained by adding the data current Idata to the first current passes through the fourth switch. The third current also flows through the fifth switch because the same current passes through both the fourth and fifth switches.

On the other hand, when the pixel current Ipixel is inputted through the second input terminal, a fourth current corresponding a current obtained by adding a current difference between the data current Idata and the pixel current Ipixel to the first current according to the kirchhoff's law flows through the sixth switch. The fourth current also flows through the seventh switch because the same current flows through both the sixth and seventh switches.

The output terminal receives the first current through the third switch and outputs the fourth current through seventh switch, so that the current corresponding to difference between the data current Idata and the pixel current Ipixel is outputted through the output terminal.

Thus, the current obtained by compensating the difference between the data current Idata and the pixel current Ipixel is outputted through the output terminal of the comparator 241.

As described above, the present invention provides a data driver and an organic light emitting diode display device including the same, in which a data current corresponding to data is compared with a pixel current in a pixel, and a data voltage (i.e. data signal) is controlled to equalize the pixel current with the data current on the basis of the comparison results, thereby displaying an image with desired brightness.

Particularly, according to an embodiment of the present invention, the data voltage is controlled by receiving the pixel current fed back from each pixel, so that an image is displayed with desired brightness regardless of non-uniformity of transistors provided in each pixel.

Although a few embodiments of the present invention have been shown and described, it would be appreciated by those skilled in the art that changes might be made to these embodiments without departing from the principles and spirit of the invention, the scope of which is defined in the claims and their equivalents.

What is claimed is:

1. An organic light emitting display device comprising:

a display region comprising a scan line, a data line, a line having a feedback function, and a pixel coupled to the scan line, the data line and the line having the feedback function;

a scan driver for supplying scan signals to the scan lines in sequence; and a data driving part coupled to the data line and the line having the feedback function, the data driving part for supplying a data voltage as a data signal to the data line, wherein the data driving part comprises a data driver, the data driver comprising:

a shift register part for generating sampling signals in sequence;

a latch part for storing external data in response to the sampling signals;

a current digital-analog converter for generating a data current corresponding to the data stored in the latch part; and a comparator comprising a first input terminal for directly receiving the data current, a second input terminal for receiving a pixel current, and an output terminal for outputting a current that is substantially equal to a difference between the pixel current and the data current, wherein the data voltage supplied to the data line by the data driving part corresponds to the current outputted through the output terminal of the comparator, a switching part coupled between the current digital-analog converter and the comparator, the switching part configured to switch the pixel current and the data current supplied to the first input terminal and the second input terminal, respectively, wherein the switching part is configured to perform a switching operation depending on a conductivity type of a first transistor of the pixel.

2. The organic light emitting display device according to claim 1, wherein the pixel comprises:

an organic light emitting diode;

the first transistor for generating the pixel current based on a voltage applied to a gate of the first transistor;

a second transistor for supplying the data voltage to the gate of the first transistor in response to a scan signal of the scan signals;

a third transistor for coupling the first transistor like a diode in response to the scan signal;

a fourth transistor for supplying the pixel current to the organic light emitting diode in response to the scan signal; and a capacitor for storing a voltage causing the pixel current to flow and for supplying the stored voltage to the gate of the first transistor.

3. An organic light emitting display device comprising:

a display region comprising a scan line, a data line, a line having a feedback function, and a pixel coupled to the scan line, the data line and the line having the feedback function;

a scan driver for supplying scan signals to the scan lines in sequence; and a data driving part coupled to the data line and the line having the feedback function, the data driving part for supplying a data voltage as a data signal to the data line, wherein the data driving part comprises a data driver, the data driver comprising:

a shift register part for generating sampling signals in sequence;

a latch part for storing external data in response to the sampling signals;

a current digital-analog converter for generating a data current corresponding to the data stored in the latch part; and a comparator comprising a first input terminal for directly receiving the data current, a second input terminal for receiving a pixel current, and an output terminal for outputting a current that is substantially equal to a difference between the pixel current and the data current, wherein the comparator compares the pixel current with the data current, controls the data voltage by increasing or decreasing the current outputted through the output terminal thereof, and supplies the controlled data voltage to the pixel;

a first capacitor coupled to the output terminal of the comparator and for storing the data voltage, wherein before being supplied to the pixel, the data voltage is controlled by increasing or decreasing a current charging the first capacitor; and a switching part coupled between the current digital-analog converter and the comparator, the switching part configured to switch the pixel current and the data current supplied to the first input terminal and the second input terminal, respectively, wherein the switching part is configured to perform a switching operation depending on a conductivity type of a first transistor of the pixel.

4. The organic light emitting display device according to claim 3, wherein the pixel comprises:

an organic light emitting diode;

the first transistor for generating a pixel current based on a voltage applied to a gate of the first transistor;

a second transistor for supplying the data voltage to the gate of the first transistor in response to a scan signal of the scan signals;

a third transistor for coupling the first transistor like a diode in response to the scan signal;

a fourth transistor for supplying the pixel current to the organic light emitting diode in response to the scan signal; and a second capacitor for storing a voltage causing the pixel current to flow and for supplying the stored voltage to the gate of the first transistor.

5. An organic light emitting display device comprising:

a display region comprising a scan line, a data line, a line having a feedback function, and a pixel coupled to the scan line, the data line and the line having the feedback function;

a scan driver for supplying scan signals to the scan lines in sequence; and a data driving part coupled to the data line and the line having the feedback function, the data driving part for supplying a data voltage as a data signal to the data line, wherein the data driving part comprises a data driver, the data driver comprising:

a shift register part for generating sampling signals in sequence;

a latch part for storing external data in response to the sampling signals;

a current digital-analog converter for generating a data current corresponding to the data stored in the latch part; and a comparator comprising a first input terminal for receiving the data current, a second input terminal for receiving a pixel current, and an output terminal for outputting a current corresponding to a difference between the pixel current and the data current, wherein the comparator compares the pixel current with the data current, controls the data voltage by increasing or decreasing the current outputted through the output terminal thereof, and supplies the controlled data voltage to the pixel; and a first capacitor coupled to the output terminal of the comparator and for storing the data voltage, wherein before being supplied to the pixel, the data voltage is controlled by increasing or decreasing a current charging the first capacitor, wherein the comparator comprises:

a first driver coupled like a diode when receiving the pixel current through the first input terminal, and enabling a first current therethrough;

a second driver coupled with the first driver to form a current mirror, the second driver being coupled with the second input terminal, and enabling a second current therethrough;

a third driver coupled with the output terminal, the third driver being coupled with the first driver to form the current mirror, and enabling the first current therethrough;

a fourth driver for receiving the pixel current through the first input terminal and enabling a third current corresponding to a sum of the first current and the pixel current therethrough;

a fifth driver coupled with the second input terminal, the fifth driver being coupled with the fourth driver to form the current mirror and enabling the third current therethrough;

a sixth driver coupled like a diode when receiving the pixel current through the second input terminal, and enabling a fourth current therethrough; and a seventh driver coupled with the output terminal, the seventh driver being coupled with the fifth driver to form the current mirror, sending a current obtained by subtracting the pixel current from the data current to the output terminal by enabling the fourth current therethrough.

6. The organic light emitting display device according to claim 5, wherein the pixel comprises:

an organic light emitting diode;

a first transistor for generating the pixel current based on a voltage applied to a gate of the first transistor;

a second transistor for supplying the data voltage to the gate of the first transistor in response to a scan signal of the scan signals;

a third transistor for coupling the first transistor like a diode in response to the scan signal;

a fourth transistor for supplying the pixel current to the organic light emitting diode in response to the scan signal; and a second capacitor for storing a voltage causing the pixel current to flow and for supplying the stored voltage to the gate of the first transistor.

7. The organic light emitting display device according to claim 6, further comprising a switching part coupled between the current digital-analog converter and the comparator, the switching part for switching the pixel current and the data current supplied to the first input terminal and the second input terminal.

8. The organic light emitting display device according to claim 7, wherein the switching part performs a switching operation depending on a conductivity type of the first transistor.

9. A data driver comprising:

a shift register part for generating sampling signals in sequence;

a latch part for storing external data in response to the sampling signals;

a current digital-analog converter for generating a data current corresponding to the data stored in the latch part;

a comparator comprising a first input terminal for directly receiving the data current, a second input terminal for receiving a pixel current, and an output terminal for outputting a current substantially equal to a difference between the pixel current and the data current, wherein the comparator compares the pixel current with the data current, controls a data voltage by increasing or decreasing the current outputted through the output terminal thereof, and supplies the controlled data voltage to a pixel; and a switching part coupled between the current digital-analog converter and the comparator, the switching part configured to switch the pixel current and the data current supplied to the first input terminal and the second input terminal, respectively, wherein the switching part is configured to perform a switching operation depending on a conductivity type of a first transistor of the pixel.

10. The data driver according to claim 9, further comprising a first capacitor coupled to the output terminal of the comparator and for storing the data voltage, wherein before being supplied to the pixel, the data voltage is controlled by increasing or decreasing a current charging the first capacitor.

11. The data driver according to claim 9, further comprising a unit gain amplifier coupled to the output terminal of the comparator and configured to raise a current drivability of the comparator.

12. The data driver according to claim 9, further comprising a capacitor coupled to the output terminal of the comparator and for storing the data voltage, wherein before being supplied to the pixel, the data voltage is controlled by increasing or decreasing a current charging the capacitor; and a unit gain amplifier coupled to the output terminal of the comparator and configured to raise a current drivability of the comparator.

13. A data driver comprising:

a shift register part for generating sampling signals in sequence;

a latch part for storing external data in response to the sampling signals;

a current digital-analog converter for generating a data current corresponding to the data stored in the latch part; and a comparator comprising a first input terminal for directly receiving the data current, a second input terminal for receiving a pixel current, and an output terminal for outputting a current substantially equal to a difference between the pixel current and the data current, wherein the comparator compares the pixel current with the data current, controls a data voltage by increasing or decreasing the current outputted through the output terminal thereof, and supplies the controlled data voltage to a pixel, and wherein the comparator comprises:

a first driver coupled like a diode when receiving the pixel current through the first input terminal, and enabling a first current therethrough;

a second driver coupled with the first driver to form a current mirror, the second driver being coupled with the second input terminal, and enabling a second current therethrough;

a third driver coupled with the output terminal, the third driver being coupled with the first driver to form the current mirror, and enabling the first current therethrough;

a fourth driver for receiving the pixel current through the first input terminal and enabling a third current corresponding to a sum of the first current and the pixel current therethrough;

a fifth driver coupled with the second input terminal, the fifth driver being coupled with the fourth driver to form the current mirror and enabling the third current therethrough;

a sixth driver coupled like a diode when receiving the pixel current through the second input terminal, and enabling a fourth current therethrough; and a seventh driver coupled with the output terminal, the seventh driver being coupled with the fifth driver to form the current mirror, enabling a current obtained by subtracting the pixel current from the data current to flow in the output terminal by enabling the fourth current therethrough.

14. The data driver according to claim 13, wherein the second current is twice the first current.

15. A method for controlling image brightness in an organic light emitting display device having a pixel for emitting light and forming an image, the method comprising:

generating a sampling signal;

storing data in a register in response to the sampling signal;

generating a data current corresponding to the stored data using a current digital-analog converter;

switching between the data current and a pixel current generated in the pixel, wherein a switching operation is performed based on a conductivity type of a first transistor of the pixel;

comparing the data current with the pixel current using a comparator configured to directly receive the data current;

generating an output current that is substantially equal to a difference between the pixel current and the data current, controlling a data voltage by increasing or decreasing the output current; and supplying the controlled data voltage to the pixel to obtain a desired image brightness, wherein the switching between the data current and a pixel current is performed using a switching part coupled between the current digital-analog converter and the comparator.

16. The method of claim 15, wherein the pixel includes a capacitor and an organic light emitting diode, the method further comprising:

supplying the controlled data voltage to the pixel in response to a scan signal, storing the controlled data voltage in the capacitor;

generating the pixel current based on the stored data voltage; and supplying the pixel current to the organic light emitting diode in response to the scan signal.

17. The method of claim 15, further comprising:

switching between the pixel current and the data current supplied for comparing.

* * * * *